US006886544B1

(12) United States Patent
Bui

(10) Patent No.: US 6,886,544 B1
(45) Date of Patent: May 3, 2005

(54) EXHAUST GAS VENTURI INJECTOR FOR AN EXHAUST GAS RECIRCULATION SYSTEM

(75) Inventor: Yung T. Bui, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/792,518

(22) Filed: Mar. 3, 2004

(51) Int. Cl.[7] ..... F02M 25/07

(52) U.S. Cl. ..... 123/568.18; 123/568.17; 123/568.24

(58) Field of Search ..... 123/568.11, 568.12, 123/568.17, 568.18, 568.19, 568.21, 568.23, 568.24; 60/605.2

(56) References Cited

U.S. PATENT DOCUMENTS

| | | | | | |
|---|---|---|---|---|---|
| 2,087,116 | A | * | 7/1937 | Prentiss | 123/568.17 |
| 3,680,534 | A | * | 8/1972 | Chavant | 123/568.17 |
| 4,426,848 | A | | 1/1984 | Stachowicz | |
| 5,611,203 | A | | 3/1997 | Henderson et al. | |
| 5,611,204 | A | | 3/1997 | Radowanovic et al. | |
| 5,617,726 | A | | 4/1997 | Sheridan et al. | |
| 5,657,630 | A | | 8/1997 | Kjemtrup et al. | |
| 6,044,827 | A | * | 4/2000 | Pfaff et al. | 123/568.18 |
| 6,343,594 | B1 | * | 2/2002 | Koeslin et al. | 123/568.17 |
| 6,386,188 | B1 | * | 5/2002 | Bender | 123/568.17 |
| 6,439,212 | B1 | * | 8/2002 | Coleman et al. | 123/568.17 |
| 6,513,508 | B2 | * | 2/2003 | Fischer et al. | 123/568.17 |
| 6,609,374 | B2 | * | 8/2003 | Feucht et al. | 123/568.17 |
| 6,651,618 | B1 | | 11/2003 | Coleman et al. | |
| 6,732,524 | B2 | * | 5/2004 | Sponton | 123/568.17 |

FOREIGN PATENT DOCUMENTS

| | | |
|---|---|---|
| EP | 0889226 B1 | 7/1997 |
| WO | WO 98-39563 | 3/1998 |

* cited by examiner

*Primary Examiner*—Willis R. Wolfe, Jr.
(74) *Attorney, Agent, or Firm*—Keith Roberson; Chris Wieland

(57) ABSTRACT

A system of operating an internal combustion engine is disclosed. The engine includes an engine block, an exhaust air system in fluid communication with the engine block, the exhaust air system having an exhaust air conduit, an intake air system in fluid communication with the engine block, the intake air system having an intake air conduit, and an intake air compressing device, an EGR system extending between the exhaust air system and the intake air system upstream of the intake air compressing device, and an ECM in communication with the EGR system. The EGR system includes an EGR injector, the EGR injector includes an EGR injector valve, an intermediate portion of intake air conduit, a throat portion positioned coaxially with the intermediate portion of intake air conduit. The throat portion extends radially inwardly of the intermediate portion of intake air conduit, the throat portion having a predetermined minimum diameter, and an end portion of an EGR conduit intersecting the intermediate portion of intake air conduit, the end portion of EGR conduit having an open end positioned coaxially with the intermediate portion of intake air conduit, the end portion of EGR conduit positioned upstream of the throat portion.

21 Claims, 2 Drawing Sheets

EXHAUST GAS VENTURI INJECTOR FOR AN EXHAUST GAS RECIRCULATION SYSTEM

TECHNICAL FIELD

This invention relates to the field exhaust gas recirculation (EGR) systems of an internal combustion engine, and, more particularly, to an EGR injector for introducing exhaust gases into the intake of a turbocharged diesel engine.

BACKGROUND

An exhaust gas recirculation (EGR) system is used for controlling the generation of undesirable pollutant gases and particulate matter in the operation of internal combustion engines. Such systems have proven particularly useful in internal combustion engines used in motor vehicles such as passenger cars, light duty trucks, and other on-road motor equipment. EGR systems primarily recirculate the exhaust gas by-products into the intake air supply of the internal combustion engine. The exhaust gas which is reintroduced to the engine cylinder reduces the concentration of oxygen therein, which in turn lowers the maximum combustion temperature within the cylinder and slows the chemical reaction of the combustion process, decreasing the formation of nitrous oxides (NO). Furthermore, the exhaust gases typically contain unburned hydrocarbons which are burned on reintroduction into the engine cylinder, which further reduces the emission of exhaust gas by-products which would be emitted as undesirable pollutants from the internal combustion engine.

When utilizing EGR in a turbocharged diesel engine, the exhaust gas to be recirculated is typically removed upstream of the exhaust gas driven turbine 1126 associated with the turbocharger. For example, in many EGR applications the exhaust gas is diverted directly from the exhaust manifold and diverted via an EGR conduit to the intake system. Likewise, the recirculated exhaust gas may be re-introduced to the intake air stream downstream of the compressor and inter-cooler or air-to-air aftercooler.

At many engine operating conditions within a turbocharged diesel engine, there is a pressure differential between the intake manifold and the exhaust manifold which essentially prevents many such simple EGR systems from being utilized. For example, at low speed and/or high load operating conditions in a turbocharged engine, the exhaust gas does not readily flow from the exhaust manifold to the intake manifold. Therefore many EGR systems include an EGR driver such as a Roots-type blower or an auxiliary compressor to force the exhaust gas from the exhaust manifold to the higher pressure intake manifold. See U.S. Pat. No. 5,657,630 (Kjemtrup et al.) issued on Aug. 19, 1997 as merely one example of the many EGR systems that utilize a pump or blower type arrangement to drive the EGR from the exhaust manifold to the intake: system. See also European Patent No. EP 0 889 226 B1 published Aug. 8, 2001 as well as PCT patent document WO 98/39563 published Sep. 11, 1998 that disclose the use of an auxiliary compressor wheel driven by the exhaust gas driven turbine associated with the turbocharged diesel engine. The auxiliary compressor wheel forcibly drives the recirculated exhaust gas from the exhaust manifold to the intake system at nearly all engine operating conditions.

One apparent problem with such forced EGR systems that utilize an auxiliary compressor is that the auxiliary compressor chokes long before the EGR flow requirements are met at many light load operating conditions. Such light load yield conditions where the exhaust manifold pressure and the auxiliary compressor, blower, pump or other EGR driver is more of a flow restriction than an assist.

It may be preferred to reintroduce exhaust gases upstream of the compressor as disclosed in U.S. Pat. No. 6,651,618 (Coleman et. al) issued on Nov. 25, 2003. Coleman discloses a low pressure EGR system that utilizes a throttle valve to control air and recirculated gases being delivered to the engine, and an EGR valve to control the amount of exhaust gases that are being reintroduced into the intake. Because exhaust gases are at a higher pressure than intake air in a low pressure EGR systems, the need for the aforementioned blower or compressor in the commonly used high pressure EGR system is eliminated. This does, however, require a means of injecting the exhaust gases into the intake. One such injecting means is found in U.S. Pat. No. 5,611,204 (Radovanovic et al.) issued on Mar. 18, 1997, which discloses various injector designs.

One apparent problem with the utilization of the throttle valve is the inefficiency caused from airflow restriction resulting from the throttle valve. Such a restriction increases the pressure and airflow loss, which may lead to choking the engine. This may result in a decrease in the fuel economy of the internal combustion engine. The performance of the EGR system is based on how much exhaust gas it can draw into the engine with minimal airflow and pressure loss. In addition, the reliability and durability of such a throttle valve is suspect to failures due to the mechanical nature of such devices.

The present invention is directed to overcoming one or more of the problems as set forth above.

SUMMARY OF THE INVENTION

According to one exemplary aspect of the present invention an exhaust gas recirculation (EGR) injector is disclosed. The injector includes an intermediate portion of intake air conduit, a throat portion positioned coaxially with the intermediate portion of intake air conduit, the throat portion extends radially inwardly of the intermediate portion of intake air conduit, the throat portion having a predetermined minimum diameter, and an end portion of EGR conduit intersecting the intermediate portion of intake air conduit, the end portion of EGR conduit having an open end positioned coaxially with the intermediate portion of intake air conduit, the end portion of EGR conduit positioned upstream of the throat portion.

According to another exemplary aspect of the present invention an internal combustion engine is disclosed. The internal combustion engine includes an engine block, an exhaust air system in fluid communication with the engine block, the exhaust air system having an exhaust air conduit, an intake air system in fluid communication with the engine block, the intake air system having an intake air conduit, and an intake air compressing device, an EGR system extending between the exhaust air system and the intake air system upstream of the intake air compressing device, the EGR system includes an EGR injector, the EGR injector includes an EGR injector valve, an intermediate portion of intake air conduit, a throat portion positioned coaxially with the intermediate portion of intake air conduit, the throat portion extends radially inwardly of the intermediate portion of intake air conduit, the throat portion having a predetermined minimum diameter, and an end portion of EGR conduit intersecting the intermediate portion of intake air conduit, the end portion of EGR conduit having an open end positioned coaxially with the intermediate portion of intake air conduit, the end portion of EGR conduit positioned upstream of the throat portion, and an ECM in communication with the EGR system.

According to yet another exemplary aspect of the present invention a method of operating an internal combustion engine is disclosed. The internal combustion engine includes an engine block, an exhaust air system having an exhaust air conduit, an intake air system having an intake air compressing device and an intake air conduit, an EGR system having an EGR injector, and an ECM. The method includes producing an exhaust gas in the engine block, transporting the exhaust gas from engine block through the exhaust air system, transporting a portion of the exhaust gas through the EGR system between the exhaust air system and the intake air system, and producing a venturi effect in the EGR injector, the venturi effect draws the exhaust gas in the EGR system into the intake air system upstream of the intake air compressing device.

It is to be understood that both the foregoing and general description and the following detailed description are exemplary and explanatory only and are not restrictive of the invention.

DETAILED DESCRIPTION

The following description is of the best mode presently contemplated for carrying out the invention.

Figure 1:
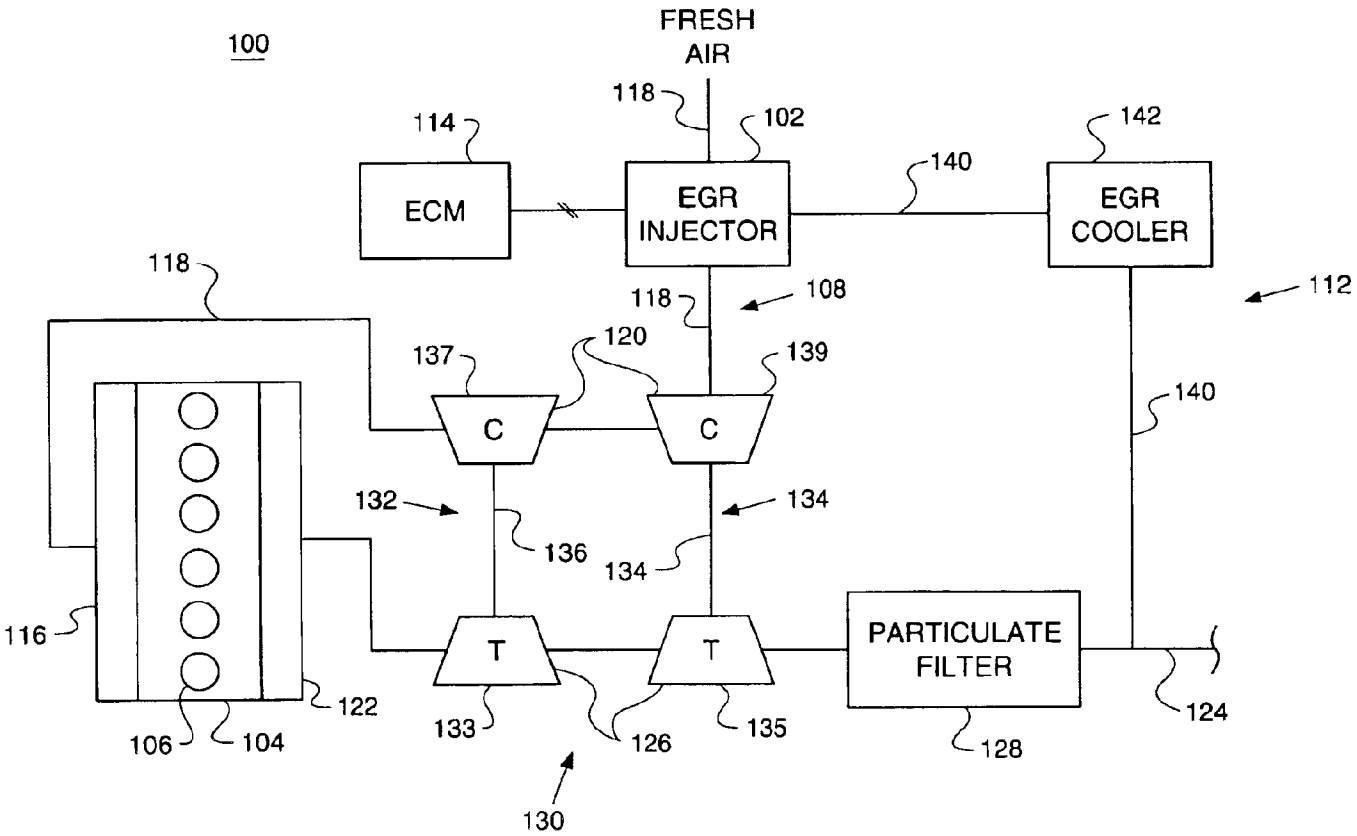
FIG. 1 depicts a schematic diagram of an internal combustion engine incorporating the exhaust gas recirculation system with the present invention.

Referring to FIG. 1, there is shown a schematic of an exemplary internal combustion engine 100 having the embodiment of an exhaust gas recirculation (EGR) injector 102 of the present invention. The internal combustion engine 100, hereinafter known as the engine 100, is that of a four-stroke, diesel engine. The engine 100 includes an engine block 104 defining a plurality of combustion chambers 106, the number of which depends on the particular application. In the exemplary engine 100, six combustion chambers 106 are shown, however, it should be appreciated any number of combustion chambers may be applicable with the present invention. Although not shown, there may be associated with each combustion chamber 106: a fuel injector, a cylinder liner, at least one air intake port and corresponding intake valve, at least one exhaust gas port and corresponding exhaust valve, and a reciprocating piston moveable within each combustion cylinder to define, in conjunction with the cylinder liner and cylinder head, the combustion chamber. The illustrated engine 100 includes an intake air system 108, an exhaust air system 110, an EGR system 112, and an engine control module 114 (ECM).

The intake air system 108 includes an intake manifold 116 removably connectable and in fluid communication the engine 100, an intake air conduit 118 capable of carrying intake air to the intake manifold 116, and a intake air compressing device 120 in fluid communication with the intake air conduit 118. The intake air compressing device 120 could be, but not limited to, a traditional turbocharger known in the art, an electric turbocharger, a supercharger, or the like. The intake air system 108 may include an intercooler or an air-to-air aftercooler, not presently shown. The intake manifold 116 provides fluid, for example, air or a fuel/air mixture, to the combustion chambers 106. The intake manifold 116 is shown as a single-part construction for simplicity, however, it should be appreciated that the intake manifold 116 may be constructed as multi-part, depending upon the particular application.

The exhaust air system 110 as shown includes an exhaust manifold; 122 removably connectable and in fluid communication the engine 100, an exhaust air conduit 124 capable of carrying exhaust gas from the exhaust manifold 122, a air compressing device drive 126 in fluid communication with the exhaust air conduit 124, and a particulate matter (PM) filter 128 in fluid communication with the exhaust air conduit 124. The exhaust manifold 122 shown as a single-part construction for simplicity, however, it should be appreciated that the exhaust manifold 122 may be constructed as multi-part or split manifolds, depending upon the particular application.

The intake air compressing device 120 and air compressing device drive 126 are illustrated as part of a turbocharger system 130. The turbocharger system 130 shown is a first turbocharger 132 and may include a second turbocharger 134. The first and second turbochargers 132, 134 may be arranged in series with one another such that the second turbocharger 134 provides a first stage of pressurization and the first turbocharger 132 provides a second stage of pressurization. For example, the second turbocharger 134 may be a low-pressure turbocharger and the first turbocharger 132 may be a high-pressure turbocharger. Each of the first and second turbochargers 132, 134 includes a turbine 133, 135, respectively and a compressor 137, 139, respectively. The turbines 133, 135 are fluidly connected to the exhaust manifold 122 via exhaust air conduit 124. Each of the turbines 133, 135 includes a turbine wheel (not shown) carried by a shaft 136, 138, respectively, which in turn may be rotatably carried by a housing (not shown), for example, a single-part or multi-part housing. The fluid flow path from the exhaust manifold 122 to the turbines 133, 135 may include a variable nozzle (not shown) or other variable geometry arrangement adapted to control the velocity of exhaust fluid impinging on the turbine wheel.

The compressors 137, 139 include a compressor wheel (not shown) carried by the shafts 136, 138. Thus, rotation of the shafts 136, 138 by the turbine wheel in turn may cause rotation of the compressor wheel.

The EGR system 112 as shown is typical of a low pressure EGR system in an internal combustion engine 100. The EGR system 112 includes an EGR conduit 140 extending between the exhaust air system 110 and intake air system 108 and capable of carrying exhaust gases, an EGR cooler 142 in fluid communication the EGR conduit 140, and an EGR injector 102 in fluid communication with the EGR conduit 140 and intake air conduit 118. As is well known in the EGR art, the EGR cooler 142 may include an air to gas cooler, a water to gas cooler or even an oil to gas cooler properly sized to provide the necessary EGR cooling. The EGR system 112 may include a soot filter (not shown) in fluid communication with the EGR conduit 140.

Some of the exhaust gases are delivered out the exhaust from the PM filter 128. However, a portion of exhaust gases are rerouted to the intake manifold 116 through an EGR cooler 142, through an EGR injector 102, and through compressors 137, 139. As shown, the exhaust gases for the EGR system 112 are extracted from the exhaust air conduit 124 downstream of the PM filter 128, however, it should be appreciated that the exhaust gases may be extracted from anywhere in the exhaust gas system, such as the PM filter 128, first or second turbochargers 132, 134, or the exhaust manifold 122.

Finally, the engine 100 includes an engine control module 114 (ECM) for operatively controlling the fuel injection timing, intake air system 108 operation, exhaust air system 110 operation, and EGR system 112 operations. All such engine system controlled operations are governed by the ECM 114 in response to one or more measured or sensed engine operating parameters, which are typically inputs (not shown) to the ECM 114.

Figure 2:
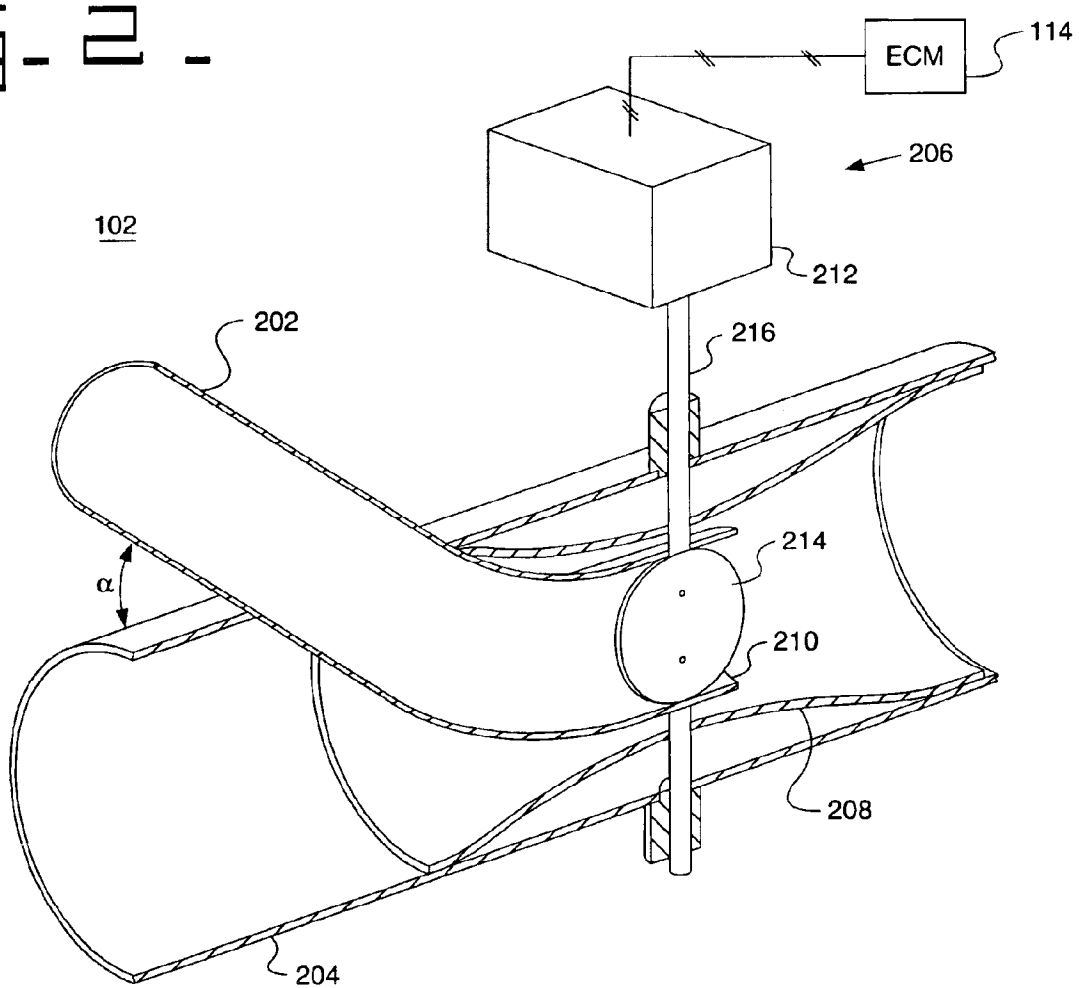
FIG. 2 depicts a perspective view of an embodiment of the present invention exhaust gas recirculation injector.

Turning now to FIG. 2, there is shown a drawing of the EGR injector 102. The EGR injector 102 includes an end portion 202 of the EGR conduit 140, an intermediate portion 204 of the intake air conduit 118, an EGR injector valve 206, and a throat portion 208. The throat portion 208 as shown is an insert slidably connected to the intake air conduit 118, however, it should be appreciated that the throat portion 208 may be a constructed using a forming process, a casting, a machining process or the like. As used herein, "throat portion" is defined as a cross-sectional area in the intake air conduit 118, in which the area for the passage of air is less than the adjacent cross-sectional area for the passage of air. As should be apparent by those of ordinary skill in such art, the throat portion 208, having a predetermined minimum diameter, forms a constriction in the intake air conduit 118, thereby producing a "venturi effect", which causes an increase in velocity of air flow and a corresponding decrease in pressure of the flowing air within the throat portion 208.

The EGR injector 102 is used to inject exhaust gas from the EGR system 112 into the intake air system 108. The end portion 202 of EGR conduit 140 intersects the intermediate portion 204 of the intake air conduit 118 upstream of the throat portion 208 at a predetermined insertion angle $\alpha$. In the embodiment shown the insertion angle 30 degrees, however, it should be appreciated that an insertion angle of approximately 0 to 90 degrees may be suitable. As illustrated in the embodiment shown, the end portion 202 of the EGR conduit 140 is bent such that when positioned inside the intermediate portion 204 of the intake air conduit 118 the end portion 202 coaxially aligns with the intermediate portion 204 of the intake air conduit 118. The EGR conduit 140 includes an open end 210 being located anywhere from upstream, but in close proximity, to the predetermined minimum diameter of the throat portion 208, to substantially downstream the predetermined minimum diameter of the throat portion 208. It should be contemplated that the in the present invention the diameter ratio of end portion 202 of the EGR conduit 140 to intermediate portion 204 of the intake air conduit 118 of more than 1, and the ratio of end portion 202 of the EGR conduit 140 to the minimum cross-sectional diameter of the throat portion 208 is less than 1.

The EGR injector valve 206 shown is position in the end portion 202 of the EGR conduit 140 such that the valve 206 may be controllably variable from an open to closed position. The EGR injector valve 206 includes an actuating device 212 and a bypass member 214 connectable to the actuating device 212. The bypass member 214 is positioned within the center section of the end portion 202 of the EGR conduit 140. In the embodiment shown, the bypass member 214 is a butterfly type valve, which is positioned by a pivotal shaft 216 connected to the actuating device 212. However, it should be contemplated that other valves such as ball valves, beak valves, spring valves, pressure compensated valves or the like may be used. The ECM 114 actuates the shaft 216 through the actuating device 212, which selectively opens and closes the bypass member 214 to control the amount of exhaust gas that flows through the EGR conduit 140. In addition, the EGR injector valve 206 may be located anywhere in the EGR system 112 as to not change or alter the present invention.

The ECM 114 controllably actuates the bypass member 214 using selected input parameters received from sensor signals, such as engine load, intake manifold pressure, engine temperature, PM filter pressure, or exhaust manifold pressure. The ECM 114 may be configured to carry out the control logic using software, hardware, and means known in the art to perform logics and execute commands.

INDUSTRIAL APPLICABILITY

During operation of the engine 100 combustion occurs, which produces exhaust gas captured by the exhaust manifold 122. The exhaust gas is transported via exhaust air conduit 124 to the turbochargers 132, 134. The turbines 133, 135 within the turbochargers 132, 134 rotatably drives the compressors 137, 139 of the turbochargers 132, 134, which compresses intake air and outputs the compressed air to the engine 100 via the intake air conduit 118. The exhaust air expelled out of the turbines 133, 135 is transported to the particulate matter (PM) filter 128 where the soot from the exhaust gas is trapped or otherwise removed from the exhaust gas downstream of the PM filter 128. Some of the exhaust gas is delivered out of the exhaust air system 110 via the exhaust air conduit 124, however, a portion of the exhaust gas is rerouted through the EGR system 112 from the exhaust air conduit 124.

Exhaust gas in the EGR system 112 is transported to the EGR cooler 142 where the hot exhaust gas is cooled. The cooled exhaust gas is then carried to the EGR injector 102 via the EGR conduit 140, where the EGR injector 102 is in fluid communication with the EGR conduit 140 and intake air conduit 118.

Fresh air is routed through the intake air conduit 118 and flows through the EGR injector 102. As the intake air flows through the throat portion 208 of the EGR injector 102 the velocity of the airflow increases and the pressure decreases. Because of the position of the EGR conduit 140 inside the intake air conduit 118, the decreased pressure at the throat portion 208 results in a venturi effect, drawing the higher pressured exhaust gas into the intake air system 108, therefore mixing the exhaust gas with the fresh air. The mixture of at least 40% exhaust gas by mass flow is then transported to the plurality of combustion chambers.

The venturi effect can be varied by sliding the throat portion 208 within the intermediate portion of intake air conduit 204 relative to the open end 210 of the EGR conduit 140. Dependent upon the pressure and velocity of the intake air through the throat portion 208, the amount of exhaust gas, which is introduced into the intake air system 108, is varied. Also, the amount of exhaust gas being introduced is dependent upon the position of the bypass member 214 of the EGR injector valve 206. By varying the position of the bypass member 214, using the ECM 114, the amount of exhaust gas being introduced into the intake air system 108 can likewise be varied. The ECM 114 controllably varies the bypass member 214 indicative of selective input parameters.

The EGR injector 102 of the present invention allows exhaust gas to be introduced into the intake air system 108 in an efficient and controllable manor. The use of the throat portion 208 generates the pressure differential needed to draw the higher pressured exhaust gas into the intake air system 108 in a low-pressure loop EGR system 112, thus, eliminating the need of a throttle valve. In addition, the use of a blower or compressor is not needed because there is no need to overcome the higher pressured compressed air in an EGR high-pressure loop.

Other aspects of the present invention may be obtained from study of the drawings, the disclosure, and the appended claims. It is intended that that the specification and examples be considered exemplary only.

What is claimed is:

1. An exhaust gas recirculation (EGR) injector, comprising:

an intermediate portion of intake air conduit;

a throat portion positioned coaxially with the intermediate portion of intake air conduit, the throat portion extends radially inwardly of the intermediate portion of intake air conduit, the throat portion having a predetermined minimum diameter; and an end portion of EGR conduit intersecting the intermediate portion of intake air conduit, the end portion of EGR conduit having an open end positioned coaxially with the intermediate portion of intake air conduit, the end portion of EGR conduit positioned upstream of the throat portion.

2. The EGR injector of claim 1, wherein the end portion of EGR conduit intersects the intermediate portion of intake air conduit at a predetermined angle.

3. The EGR injector of claim 2, wherein the end portion of EGR conduit is bent.

4. The EGR injector of claim 3, wherein the open end of the end portion of EGR conduit being located in close proximity of the predetermined minimum diameter of the throat portion.

5. The EGR injector of claim 1, wherein the throat portion is an insert.

6. The EGR injector of claim 1, further including an EGR injector valve positioned in fluid communication with the end portion of EGR conduit.

7. The EGR injector of claim 6, wherein the EGR injector valve includes:

an actuating device;

a bypass member positioned concentrically with the end portion of the EGR conduit; and a shaft connecting the actuating device and the bypass member.

8. The EGR injector of claim 7, wherein the bypass member is a butterfly valve.

9. An internal combustion engine, the engine includes an engine block defining a plurality of combustion chambers, comprising:

an exhaust air system in fluid communication with the plurality of combustion chambers, the exhaust air system having an exhaust air conduit;

an intake air system in fluid communication with the plurality of combustion chambers, the intake air system having an intake air conduit, and an intake air compressing device;

an EGR system extending between the exhaust air system and the intake air system upstream of the intake air compressing device, the EGR system includes an EGR injector, the EGR injector includes an EGR injector valve, an intermediate portion of intake air conduit, a throat portion positioned coaxially with the intermediate portion of the intake air conduit, the throat portion extends radially inwardly of the intermediate portion of intake air conduit, the throat portion having a predetermined minimum diameter, and an end portion of EGR conduit intersecting the intermediate portion of intake air conduit, the end portion of EGR conduit having an open end positioned coaxially with the intermediate portion of intake air conduit, the end portion of EGR conduit positioned upstream of the throat portion; and an ECM in communication with the EGR system.

10. The engine of claim 9, wherein the end portion of EGR conduit intersects the intermediate portion of intake air conduit at a predetermined angle.

11. The engine of claim 10, wherein the end portion of EGR conduit is bent.

12. The engine of claim 11, wherein the open end of the end portion of EGR conduit being located in close proximity of the predetermined minimum diameter of the throat portion.

13. The engine of claim 9, wherein the throat portion is an insert.

14. The engine of claim 9, wherein the EGR injector valve positioned in fluid communication with the end portion of EGR conduit.

15. The engine of claim 14, wherein the EGR injector valve includes:

an actuating device;

a bypass member positioned concentrically with the end portion of the EGR conduit; and a shaft connecting the actuating device and the bypass member.

16. The engine of claim 15, wherein the bypass member is a butterfly valve.

17. The engine of claim 14, wherein the ECM is in communication with the EGR injector valve.

18. A method of operating an internal combustion engine, without a throttle valve, having an engine block defining a plurality of combustion chambers, an exhaust air system having a exhaust air conduit, an intake air system having an intake air compressing device and an intake air conduit, an EGR system having an EGR injector, and an ECM, comprising:

producing an exhaust gas in the engine block;

transporting the exhaust gas from engine block through the exhaust air system;

transporting a portion of the exhaust gas through the EGR system between the exhaust air system and the intake air system;

transporting fresh air through the EGR injector, and producing a venturi effect in the EGR injector, the venturi effect draws the exhaust gas in the EGR system into the intake air system upstream of the intake air compressing device.

19. The method of claim 18, wherein producing the venturi effect in the EGR injector, the EGR injector having a throat portion with a predetermined minimum diameter, an end portion of EGR conduit, and an intermediate portion of intake air conduit, includes:

transporting intake air through the throat portion;

reducing pressure of the intake air in the throat portion; and injecting higher pressure exhaust gas from the end portion of EGR conduit coaxially into the intermediate portion of intake air conduit in close proximity to the predetermined minimum diameter of the throat portion.

20. The method of claim 18, the EGR injector having an EGR injector valve, further includes:

sending a signal from the ECM to the EGR injector valve indicative of selective input parameters; and varying the amount of exhaust gas being introduced into the intake air system.

21. The method of claim 20, further including transporting a mixture of fresh air and exhaust gas to the plurality of combustion chambers, wherein the mixture is at least 40% exhaust gas by mass flow.

* * * * *